US005246142A

United States Patent [19]

DiPalma et al.

[11] Patent Number: 5,246,142

[45] Date of Patent: Sep. 21, 1993

[54] DEVICE FOR STORING TWO PRODUCTS SEPARATELY AND SUBSEQUENTLY MIXING THEM

[76] Inventors: Elio DiPalma; Josephine DiPalma, both of 24 Millcroft Way, Thornhill, Ontario, L4J 6P1, Canada, L4J 6Pl

[21] Appl. No.: 768,372

[22] Filed: Sep. 26, 1991

[51] Int. Cl.[5] ..... B65D 25/08

[52] U.S. Cl. ..... 222/129; 206/219; 206/222; 215/DIG. 8

[58] Field of Search ..... 222/83, 83.5, 87, 129, 222/145, 541; 206/219, 222; 215/227, DIG. 8; 220/277

[56] References Cited

U.S. PATENT DOCUMENTS

| | | | |
|---|---|---|---|
| 2,859,898 | 11/1958 | Mendenhall | 222/1 |
| 3,305,368 | 2/1967 | Bourelle | 99/171 |
| 3,310,206 | 3/1967 | Littlefield | 222/541 X |
| 3,347,403 | 10/1967 | Lehrman | 220/17 |
| 3,347,410 | 10/1967 | Schwartzman | 222/80 |
| 3,425,598 | 2/1969 | Kobernick | 222/83 |
| 3,458,076 | 7/1969 | Babcock | 215/6 |
| 3,567,061 | 3/1971 | Song | 222/541 X |
| 3,743,520 | 7/1973 | Croner | 99/171 B |
| 3,891,125 | 6/1975 | Morane et al. | 222/129 |
| 3,924,741 | 12/1975 | Kachur et al. | 206/221 |
| 4,132,308 | 1/1979 | Goncalves | 206/219 |
| 4,386,696 | 6/1983 | Goncalves | 206/219 X |
| 4,821,923 | 4/1989 | Skorka | 222/145 X |
| 4,903,865 | 2/1990 | Junowitz | 222/83.5 |

*Primary Examiner*—Andres Kashnikow
*Assistant Examiner*—Anthoula Pomrening
*Attorney, Agent, or Firm*—Eckert Seamans Cherin & Mellott

[57] ABSTRACT

A novel mixing and dispensing container is provided herein. The novel container includes a container for containing a first ingredient, the container including an internal shoulder therein; (b) a dispenser compartment for insertion into the container, for storing a second ingredient which is segregated from the first ingredient prior to use, the dispenser compartment having a preformed weakened region in a selected wall thereof; (c) a removable closure for the container, the removable closure being connected to the dispensing compartment, the removable closure being adapted to close the container; and (d) a projection on the dispenser compartment for engaging the shoulder during removal of the closure. Opening of the container by removal of the removable closure causes the projection on the dispenser compartment to engage the shoulder in the container. This permits another portion of the dispenser compartment to be raised with respect to the container. This, in turn, ruptures the weakened region of the selected wall of the dispenser compartment, and consequently dispenses the second ingredient into the first ingredient.

10 Claims, 6 Drawing Sheets

DEVICE FOR STORING TWO PRODUCTS SEPARATELY AND SUBSEQUENTLY MIXING THEM

BACKGROUND OF THE INVENTION (i) Field of the Invention

The present invention relates to the combination of a container and a dispenser compartment therein and therefor, by means of which a user can prepare a fresh solution or suspension of two or more ingredients and can readily dispense the same.

(ii) Description of the Prior Art

Many drugs, dyes and other chemicals are frequently supplied in powder or crystal form and do not retain their stability, strength and effectiveness for long after they have been mixed in solution or suspension, a condition frequently necessary for their administration or other use. Thus, for example, it is desirable to keep drugs, e.g. penicillin or novocain, dry and to admix them with the solvent immediately before use. Likewise, it is important to keep certain synthetic resins and their curing catalysts separate until immediately before use in order to prevent premature curing. It is also important that admixtures of various chemicals be done under conditions wherein a measured amount of one chemical be added to a measured amount of the other chemical to insure that proper results are obtained with a minimum of waste.

In preparing carbonated beverages, it is well known that many syrups, are sensitive to acid and react in the presence of carbonic acid during extended storage periods. Accordingly, it has been the practice to mix such acid-sensitive syrups with carbonated water immediately prior to consumption at restaurants and soda fountains.

There are also many examples of materials or substances which have an extended shelf life when not mixed, but which must be utilized relatively soon after mixture to prevent deterioration. Various cosmetics, medications, hair dyes, pigments, epoxy adhesives, polishes, cleansing solutions and the like have the foregoing characteristics. For example, conventional hair dyes employ a base material, e.g. a peroxide solution or the like, with which a pigmented material or solution is mixed for immediate application on the hair. The color is determined by the make-up of the pigmented solution. If the pigmented material is mixed with the base and allowed to stand, the mixture may rapidly deteriorate and thus become unusable.

Another example is that of dental materials which are composed of items requiring separation until immediately prior to mixing and use. Such items include, particularly, materials known as "silicates" in which a dry silicate type material is mixed with a liquid agent, and in which resins of various types are contained. When mixed and activated with a liquid, the silicate materials and resins undergo a chemical change in a very short time and set into a hard, nearly indestructible, mass. Such materials are used for filling teeth and are very effective and relatively easy to apply, but cause problems in the necessity of accurate proportioning and mixing under normal circumstances.

Yet another example is in the merchandising of certain products, where it is frequently desirable to supply two companion products to the consumer in a single package. Thus, many products are, by their very nature, required to be used by the consumer shortly after their manufacture as they lose certain desirable characteristics within a short period of time. Yet, the product can be stored for extended periods of time if a reactive compound thereof is maintained separate from the base compound. In such case, the two compounds may be mixed together to form the desired product shortly before use. In marketing such goods, it obviously is desirable that the reactive compound and the base compound be sold as part of the same package. From an aesthetic as well as a handling standpoint, it is desirable that but a single package be utilized for maintaining such compounds separated.

In the chemical, cosmetic and pharmaceutical industries it is often necessary to store separately two products which are not to be mixed until just before the resulting mixture is to be used because the properties of that mixture are not acceptable for the application envisaged except at the moment at which the mixture is formed. The stability and viscosity of the mixture, for example, are among the properties which may vary in the course of time and may therefore have values which are acceptable from the point of view of the use of the mixture only during a brief period determined by prior experience and usually beginning at the time the mixture is formed.

In a practical way of providing such desired results, containers have been provided having two compartments in which two ingredients of a product may be stored separately until it is desired to mix them, at which time it is possible to establish communication between the compartments so that the separated ingredients may move from one compartment to the other.

It is known in the art to provide dispensers containing a concentrate of soluble materials to a fixed quantity of solute, usually water, for dispensing as a spray upon an object to be treated. Thus, the prior art teaches containers for beverages wherein the interior of the container is divided into a compartment having a basic ingredient and a compartment which can be ruptured so as to mix, within the container the basic ingredient and some form of modifier or flavouring. The basic reason for this prior art container is to provide the mixing action at the time of consumption since prior mixing would have adverse effects. The basic ingredient is not usually suitable for consumption and requires mixing with the modifier prior to consumption.

In one such device, the neck of the container is externally threaded and is closed by a cap provided with an internally threaded skirt extending toward the bottom of the container. The cap has a recess in its inner annular surface opposite the neck of the container which may be closed by a capsule having a projecting part in the form of an elastic collar the external dimensions of which are greater than the internal dimensions of the neck of the container. The container is filled with a first product, generally liquid, and the cap, turned upside down, is filled with at least one additional liquid or pulverulent product. After closing the cap by screwing the cap thereonto the collar of the capsule deforms as the central part of the cap passes along the neck of the container. This deformation is of course such that the collar assumes a generally curved-shape which is concave toward the cap.

After complete screwing of the cap onto the neck of the container the collar of the capsule is not then subjected to any constraint and because it is not then subjected to any constraint it returns to its original configuration, which is substantially flat and perpendicular to the longitudinal axis of symmetry of the neck of the container. The two products stored in the container and in the cap are then completely separated from each other. At the moment that the desired mixture is prepared, the cap is unscrewed, which has the effect of bringing the collar of the capsule again into contact with the neck of the container. If one continues to unscrew the cap the collar engages the neck of the container and catches at this point so that the capsule closing the cap is held at the bottom of the neck of the container while the cap continues to move upwardly. The capsule is progressively released from the cap and then, after total liberation, drops into the container which has the effect of permitting the additional product to drop into the container and mix with the product originally stored therein.

Thus, as disclosed above, the concentrate is contained within a threaded cap which is ruptured as the cap is threadedly engaged upon the container containing the solute, permitting the contents to fall into the solute for mixing.

While such prior art containers were useful and generally provided a solution to some of the problems above outlined, considerable effort has been expended in providing improvements thereon. For example, U.S. Pat. No. 2,859,898, patented Nov. 11, 1958 by Ivan L. Mendenhall, provided the combination of a container and a cap adapted to hold a substance for admixture with the contents of the container and to serve as a dispenser for the admixture. The container had a hollow, externally-threaded end and a sealing film at the top of that threaded end. The cap was provided with an internally threaded skirt and end wall, a shorter inner wall concentric with the skirt and terminated in the end wall defining a reservoir for holding a substance to be mixed with material in the container. A sharp, film-cutting element was provided at the end of the inner wall in sealing engagement with the sealing film, so that material in the reservoir cannot spill. An opening was provided in the end wall concentric with the skirt and was of lesser diameter than the inner wall for dispensing material after admixture of the substance in the cap with the contents of the container. A closure was also provided for closing the opening.

U.S. Pat. No. 3,305,368, patented Feb. 21, 1967 by Joseph G. Bourelle, provided a sealed compartmented container having a top wall and a compartment wall underlying and spaced adjacent to the top wall. This patentee provided a sealed, compartmented beverage container having a side wall, a bottom wall, and a continuous top wall having its periphery crimped over the top edge of the side wall in fixed engagement and extending in planar relationship between the crimped periphery. A readily-rupturable compartment wall member underlay the top wall, generally coextensive therewith and divided the interior of the container into an upper compartment thereabove containing acid-sensitive syrup and a lower compartment therebelow containing carbonated water. The compartment wall member provided a substantially gas and moisture-impermeable seal for the syrup therein and isolated the syrup from the carbonated water. The compartment wall member had a bottom wall portion and a side wall portion and was sealingly engaged at its upper end with the top wall to define the upper compartment. The bottom wall portion was spaced from the top wall a distance less than the length of the blade of a common can opener so as to be rupturable during puncturing of the top wall by a common can opener engaged with the crimper periphery of the top wall portion to permit the syrup to flow into and mix with the carbonated water.

U.S. Pat. No. 3,347,403, patented Jan. 11, 1966 by D. Lehrman, provided a pair of containers, one within the other. The patentee provided a container comprising an inner vessel, an outer vessel, and means for mounting the inner vessel completely within the outer vessel. The inner and outer vessels had caps and cap-receiving neck portions. The cap-receiving neck portion of the inner vessel was substantially smaller than the cap-receiving neck portion of the outer vessel, and the inner vessel was smaller than, and completely contained inside of, the outer vessel. The means for mounting the inner vessel within the outer vessel included an adapter having an upright portion within the outer vessel and a radially-outwardly-extending flange at the upper end of the upright portion. The adapter was removably attached to the outer vessel by engagement between the flange and the cap-receiving neck portion of the outer vessel. Such engagement supported the adapter within the outer vessel. The upright portion of the adapter contained at its lower end, a radially-inwardly-extending flange which was smaller than the outer periphery of the cap of the inner vessel. That flange was removably attached to the inner vessel by engagement with the bottom horizontal surface of the cap. In that way, the inner container was supported completely within the outer container.

U.S. Pat. No. 3,347,410, patented Oct. 17, 1967 by Gilbert Schwartzman, provided an applicator for use with a container provided with a neck having an open end and having a first substance disposed therein. The applicator included a retainer ring having a projecting portion for reception in the neck, and a portion overlying the open end. The applicator further included an outer fitting detachably engaging the outer surface of the neck. The applicator head had openings therethrough. A resilient bellows was integral with the applicator head and the fitting and connected the fitting to the applicator head. The projecting portion was provided at its lowermost end with sealing means to hold a second substance within the retainer ring. A stem was integrally formed with and depended from the applicator head and was engageable with the sealing means upon depression of the applicator head and bellows to open the sealing means to permit the second substance to mix with the first substance. The bellows normally urged the stem away from the sealing means.

U.S. Pat. No. 3,425,598, patented Feb. 4, 1969 by Gerald Kobernick, attempted to provide a solution to certain problems relating to the viscosity of the liquid used, and its tendency to adhere to the chamber in which it was stored, and to solve the problem of severing a membrane separating two cavities. This problem was said to be solved by such patentee in a device for prepackaging dental materials utilizing a liquid and a powder. The device included a chamber closed at one end and open at the other end and containing powder. A collar was provided having a restricted opening. Means were provided for attaching the collar to the open end of the chamber. A packet of liquid was sealed in a rupturable membrane and had a flange about its perimeter, the membrane being positioned in the opening with the flange resting on the collar. A cap was detachably attached over the collar. Rupturing means and motion limiting means were provided which included a disk carried by the rupturing means depending from the interior of the cap. Upon partial sliding movement of the cap with respect to the collar, the rupturing and motion limiting means ruptured the membrane, thus causing the liquid therein to empty into the chamber. The disk limited the movement of the cap and held the flange against the collar to insure that the disk and membrane would not be forced into the chamber during the rupturing process.

U.S. Pat. No. 3,458,076 patented Jul. 29, 1969 by Dudley S. Babcock, provided a multicompartment package including an outer container having an annular ledge adjacent its upper end. An inner container was telescoped within the outer container, the inner container having a radially-outwardly-extending annular bead sized to overlie the annular ledge and resting thereon. Either the annular ledge or the annular bead was deformable to permit the annular bead to be urged past the annular ledge to the interior of the outer container. Closure means engaged the upper end of the outer container for closing the package.

U S. Pat. No. 3,305,368, patented Feb. 21, 1967 by J. G. Bourelle provided a beverage container including a structure which divided the interior of a can into a compartment for a basic ingredient and a compartment, co-extensive with and underlying the top of the can, for a flavouring syrup. Rupturing of the top of the can with an ordinary can opener also ruptured the bottom of the underlying compartment to cause mixing of the contents of the two compartments.

U.S. Pat. No. 3,743,520, patented Jul. 3, 1973 by Jerome T. Croner, attempted to solve the problem where the construction of the container was such that removal of the ingredients of the container was restricted and the entire contents difficult to remove. In the patented invention, a beverage container was provided having a bottom, side, and top walls, and a rupturable compartment for a modifying ingredient which underlay only a portion of the container top so that the top can be selectively ruptured to provide access to only the basic beverage, the underlying compartment, or both. By provided side walls to the underlying compartment, several compartment sections can be provided, each with a different modifying ingredient. The top of the container was provided with suitable markings to indicate the location and contents of the sections. By suitable construction of the underlying compartment, the bottom wall portion of the compartment, or certain ones of the sections, can be spaced differently from the top wall of the container. The rupturing of the top of the container and underlying compartment or section by a can opener, may or may not rupture the bottom of the container or section. Thus, mixing of the basic beverage and modifying ingredients of the compartment or section can take place within the container or in another receptacle.

U.S. Pat. No. 3,891,125, patented Jun. 24, 1975 to Bruno Morane et al, provided a device for storing two products separately which purported to solve the problem in a device which had the inherent disadvantage with respect to the structure of one of its components, specifically, the collar of the capsule. The patentee provided an improved device for storing and dispensing a mixture of a first product and at least one additional product. The device included a container for holding the first product, the container being provided with a neck. A hollow, spout-shaped dispensing cap defined a recess for holding at least one additional product, the cap being provided at one end with a skirt adapted to fit onto the outside of the neck, with an annular surface between the skirt and the edge of the recess, and with integral means at its other end adapted to create a dispensing orifice when removed from the cap. A capsule was provided which acted as a closure for the recess when the capsule was located therein, the capsule having a first end which was a force fit in the recess and a second end provided with a supporting flange which projected radially outward therefrom. A cup was provided having sides adapted to be received in the neck and a bottom defining an opening through which the first end of the capsule projected into the recess, so that the bottom of the cup was gripped between the supporting flange on the capsule and the annular surface on the cap. The outer diameter of the capsule was less than that of the opening in the bottom of the cup so that the capsule was slidable with respect to the opening and the outer diameter of the supporting flange was greater than the diameter of the opening in the bottom of the cup but less than the inner diameter of the sides of the cup. Means were provided for frictionally retaining the sides of the cup in the neck of the container. When the cap was moved away from the container along the neck, the capsule was prevented by the flanges from being removed with the cap, but was instead separated from the cap so as to be free to fall into the container.

U.S. Pat. No. 3,924,741, patented Dec. 9, 1975 by Nicholas W. Kachur provided a two-compartment container for separate storage of two ingredients of a product for eventual mixing. The container comprised a bottle having a cylindrical neck on which a stopper and a capsule assembly was mounted and was secured thereto by conventional means, e.g. screw threads, or a bayonet joint, or by a "snap-on" interference fit. The stopper comprised a tubular sleeve which extended downwardly through the bottle neck and terminated in a transverse wall which closed the lower end of the sleeve. The tubular wall of the lower portion of the sleeve adjacent the transverse wall had a plurality of apertures extending therethrough. A tubular capsule was slidably mounted within the tubular sleeve to move between upper and lower terminal positions. In the lower terminal position of the capsule, the lower portion of the tubular wall of the capsule closed and sealed the apertures. Also, the tubular wall terminated in a circular rim which seated against the transverse wall of the sleeve to seal the lower end of the capsule. Thus, in the lower terminal position of the capsule, the contents of the capsule were effectively separated from the contents of the bottle. When the capsule was moved to its upper terminal position, however, the apertures in the sleeve were opened and the contents of the capsules were permitted to fall int the bottle. A closure cap was mounted on the upper end of the capsule and may be secured thereto in any suitable manner.

U.S. Pat. No. 4,903,865, patented Feb. 17, 1991 by C. Michael Jurowitz, provided a push button cap containing an additive for containers which attempted to solve certain problems of the prior art. One such problem was the inability of the use to determine when rupture had occurred. Should the concentrate be of the same color as the solute, the user had no way of knowing that the concentrate has become released and dissolved or mixed with the solute without removing the charging device from the container. Another problem lay in the fact that the point at which rupture of the capsule occurred depended upon the engagement of the capsule with portions of the threaded container which did not effect a sealing relationship between the cap and the container. Thus, it was possible to have the capsule rupture before the cap was completely engaged upon the neck of the container. If, at that point, the container was shaken, or otherwise manipulated for mixing, leakage of the contents of the container may occur. The patented device which was intended to solve such problem included the combination of a container having a threaded neck forming an opening communicating with the interior of the container and a liquid dispensing element including an outer cap having a planar end wall having a central opening therethrough, and a cylindrical internally threaded side wall. A capsule element was provided having a first lower member and a second upper member slidably engaged therewith. The first lower member included a cylindrical side wall having a radially extending flange at an upper end thereof forming a seal between the threaded neck of the container and the outer cap, and a lower wall frangibly interconnected to the last-mentioned cylindrical side wall at a lower end thereof. The second upper member included an upper wall and a cylindrical hollow shank having a principal axis perpendicular to the plane of the upper wall and penetrating the opening in the planar end wall of the cap, the shank having a lower free edge overlying an area of frangible interconnection between the lower wall and the cylindrical side wall of the second upper member. The capsule element was positioned within the cap such that the upper wall of the second upper member contacted the upper end wall of the cap, engagement of the cap with the threaded neck of the container serving to elevate the capsule element relative to the cap and to move the upper wall of the second upper member into spaced relation relative to the planar end wall. Downward pressure exerted upon the upper wall served to cause movement of the shank relative to the lower wall of the first lower member to sever the frangible interconnection between the lower wall and the cylindrical side wall.

Even with the many alleged improvements to the containers as described above, it is often very messy to mix these solutions together using separate containers. Accordingly, it would be desirable to overcome these difficulties by providing a unitary storage and mixing facility, especially to overcome difficulties in storage which have limited the packaging of beverages for facile home or shop use.

SUMMARY OF THE INVENTION (i) Aims of the Invention

In spite of the above discussed patents which purported to provide improvements in the above-described container, there is still a need for the provision of an improved device in which the above-mentioned disadvantages have been substantially eliminated.

Accordingly, it is an object of the present invention to provide a package in which two separate products may be contained in a separated condition.

Another object of the invention is to provide a means for maintaining properly proportioned amounts of the materials in one disposable capsule, so that the user may easily and quickly mix proper amounts in an accurate and uniform manner, and very quickly and economically.

Still another object of this invention is to provide an improved charging device permitting the user to conveniently make a solution from a pre-measured liquid concentrate without the necessity of contacting the materials used and without the danger of spillage.

Yet another object of the present invention is to provide a package for storing and, mixing a plurality of chemicals with a minimum of time and effort.

An additional object is to provide a novel attachment for a container cap suitable for use as a reservoir for a chemical.

Another object is to provide a novel package for storing, mixing and then dispensing chemicals with little or no danger of contamination.

A further object of the invention is an improved method of storing and mixing chemicals.

A related object is to provide such a container which may be easily fabricated from readily available materials and which is relatively inexpensive and relatively foolproof in use.

Another object of the invention resides in several different types of novel sealing means adapted to be opened upon actuation to permit mixture of the substances.

It is yet another object of this invention to provide a means for dispensing completely and accurately predetermined portions of liquid into a predetermined portion of dry material within a prepackaged capsule.

It is a further object of this invention to provide a capsule capable of cooperation to expel accurately proportioned material together for mixing.

It is a further object and advantage of the invention to provide a method for proportioning materials for the purpose of accurate and expeditious mixing immediately prior to use.

It is another object of the present invention to provide a package in which two separate products may be contained in a separated condition.

It is a further object of the present invention to provide a package in which two different products are separated within two individual containers, one of which is telescoped within the other and which are closed by means of a single closure.

It is a further object of the present invention to provide a package in which the inner telescoped container may be manipulated to cause mixing of the respective products by a simple movement of the closure.

It is yet another object of the present invention to provide such a container which is simple to construct, easy to operate both as to filling with the separated ingredients and as to discharge of the mixed product, and which embodies certain safety features which protect against accidental, premature mixing of the separated ingredients, and against accidental discharge of the mixed product.

(iii) Other Features of the Invention

In one feature of the invention, the container is a bottle having a neck, which may have either a square shoulder or a rounded shoulder. The neck preferably includes external threads thereon and the removable closure is thus a screw cap.

In one preferred embodiment of this combination, the opening of the container by removal of the removable closure causes a rupture of the dispenser compartment along the weakened region of the selected wall, thereby to dispense the second ingredient into the first ingredient.

In one feature of this type of container, the dispenser compartment may be a cylindrical body adapted to be concentrically disposed within the neck, the dispenser compartment having a closed end provided with score lines and, actuatable means causing vertically upward movement of the dispenser compartment with respect to the neck to effect rupturing along the score lines of the dispenser container. The bottom of the dispenser compartment may be conically-shaped, so that the score lines are within the conical area and so that the score lines may be acted upon to effect rupturing along the score lines. The dispenser compartment may be provided with a filler hole within which a plug is adapted to be placed to seal the dispenser.

The dispenser compartment may further include an upper flange. A cap preferably is secured to the upper flange. The cap may be of the "pry-off" type or of the "twist-off" type. If it is the "twist-off" type, rotation of the cap causes the vertically upward movement of the dispenser.

In another feature of the invention the dispenser compartment is a cylindrical body adapted to be concentrically disposed within the neck, the dispenser compartment having a closed end lid hingedly secured to one end of the cylindrical body by a living hinge weakened section, the lid being secured to the other end of each cylindrical body by cooperation between a protrusion and a latch, and actuatable means causing vertical upward movement of the dispenser compartment with respect to the neck to effect unhinging and opening of the lid. In such embodiment, the upper end of the dispenser cylinder is secured to a closure cap, and wherein the closure cap is of the "twistoff" type.

In another feature of the invention, the dispenser compartment is a cylindrical body adapted to be concentrically disposed within the neck, the dispenser compartment having a lower constricted oval cross-section closed end, having weakened or thinner walls, and concentrically disposed within an oval neck of the bottle, an actuatable means, to rotate the dispenser compartment with respect to the container to fracture and implode the weakened wall of the dispenser compartment. In such embodiment, the upper end of the dispenser cylinder is secured to a closure cap, and wherein the closure cap is of the "twist-off" type.

In another feature of this type of container, the dispenser compartment may be a cylindrical member provided with a spiral score line providing the preformed weakened portion. In such feature, means are provided for preventing rotation of the cylindrical member while it is within the container, and means, which are associated with the bottle cap, are provided for attempting to rotate the dispenser compartment to rupture the cylindrical member along the spiral score line. To enable prevention of rotation of the dispenser compartment when it is within the container, the bottom of the dispenser compartment may include a geometrically-shaped, in cross-section, end to mate with a similar geometrically-shaped, in cross-section, upstanding stub on the bottom of the bottle. The upper end of the cylinder may be provided with an upper flange or with a closure clip. The closure cap is of the "twist-off" type.

If the cap is the "pry-off" type, the dispenser container comprises a cylindrical member, having a closed bottom and a plurality of axially-arranged score lines or weakened areas at the bottom thereof, and actuatable means cooperating with upward vertical movement of the dispenser with respect to the neck to effect rupturing of the dispenser compartment along the score lines. The actuatable means may comprise a flange-like trigger extending from the dispenser compartment.

In yet another embodiment of this invention, the dispensing container may be a cylindrical member having a rectangular lower end, the lower end being provided with a swinging bottom trap door, latched to a latch at one side wall of that rectangular lower end by a protuberance, and hinged to an opposed wall by a weakened linear area. In such embodiment the neck of the bottle may be internally threaded and wherein the upper portion of the dispensing container is externally threaded.

In still another embodiment of this invention, the dispensing container may be a cylindrical member, the cylindrical wall being provided with a swingable door latched to a region of the neck of the bottle by an internally focus latch engaging an externally facing protrusion, the lower edge of the door being hinged to the cylindrical wall by a weakened linear area. In such embodiment, the neck of the bottle may be internally threaded and wherein the upper portion of the dispensing container is externally threaded.

In a still further embodiment of this invention, the neck of the bottle may include a portion of oval cross-section, and the dispensing container is likewise of general cylindrical shape having a portion of oval cross-section, the walls of the dispensing container at the oval cross-section area being thin and frangible. In such embodiment, the neck of the bottle may be internally threaded and wherein the upper portion of the dispensing container is externally threaded.

In yet another embodiment, the container comprises a can provided with a crimped lid, which is adapted to be opened with a conventional bottle opener.

The container may be a can provided with a dispenser compartment below the lid thereof, the dispenser compartment including a preformed weakened region at the bottom thereof which is openable by a pressure from a bottle opener simultaneously with the opening of the can. The can may be provided with an opening tab therein for opening the can and the compartment substantially simultaneously. Alternatively, the removable closure may be a crimped closure, removable by a conventional bottle opener.

(iv) Generalized Description of the Invention

In one embodiment of the invention, a dispenser compartment having flexible walls is placed into a filled bottle prior to the bottle being capped. Filling of the dispenser compartment causes the lower flexible walls to fit tightly into the neck of the bottle, pushing trigger tabs out to the locked position.

A plug is placed into the filler hole and the bottle is ready for the capping procedure, which compresses the plug to seal the filler hole and to adhere the dispenser flange to the cap.

By opening the bottle in the normal fashion, i.e. unscrewing the cap and pulling it away from the bottle, the trigger tabs are caught against a square shoulder of the bottle. The tabs pivot up into the neck, which ruptures the dispenser along the score lines, thus releasing the contents into the bottle to produce a freshly mixed drink.

In another embodiment of the invention, the dispenser compartment is a cylindrical member having spiral score lines therearound. The dispenser compartment is placed into a filled bottle prior to the bottle being capped, with a slight twisting motion allowing the hexagonal bottom of the container to lock down onto the dispenser compartment. The capping process adheres the dispenser compartment flange to the inside of the bottle cap, thus locking the top section of the dispenser to the cap.

The spiralling score is scribed onto the outside of the dispenser at the time of manufacturing. The twisting of the cap to open the bottle will cause the dispenser compartment to rupture along the score line, allowing the fluid to be mixed with the contents of the bottle.

As the twist top cap is moved away from the bottle the dispenser compartment is carried along with it to be appropriately disposed of.

BRIEF DESCRIPTION OF THE DRAWINGS

In the accompanying drawings.

Figure 1:
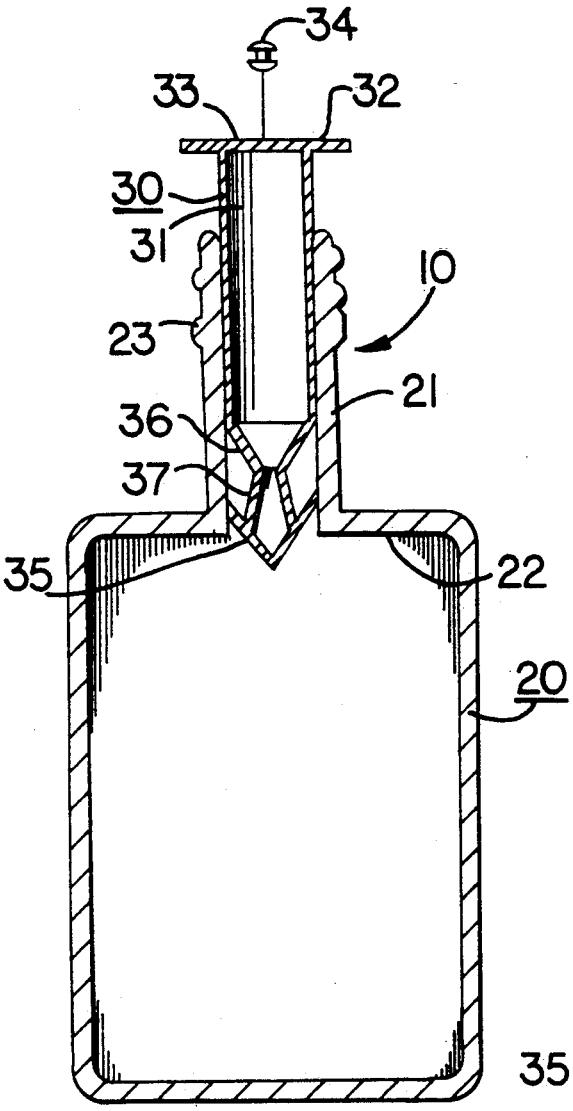
FIG. 1 is a central longitudinal section of one embodiment of the present invention with the dispenser compartment disposed in the neck of a container but before loading of the dispenser compartment.

DESCRIPTION OF THE PREFERRED EMBODIMENTS (i) Description of FIGS. 1–5

As seen in FIGS. 1–5, that embodiment of the invention 10 depicted therein includes a bottle 20 including a neck 21, arising from square shoulders 22 and provided with external screw threads 23.

Within the neck 21 is the dispenser compartment 30 which is in the form of a flexible cylindrical member 31. The top of the member 31 is provided with a cover flange 32, the cover flange 32 including a filling hole 33 which is adapted to be closed by a plug 34. The bottom of the dispenser compartment 30 includes a conical end 35 provided by a temporarily-folded-in, diverging, frusto-conical portion 36 and a converging, frusto-conical portion 37. The temporarily-folded-in portions 36, 37, seen in FIG. 1 provide the lower cylindrical end of the dispenser compartment, which has the conical end 35 seen in FIG. 2.

Figure 3:
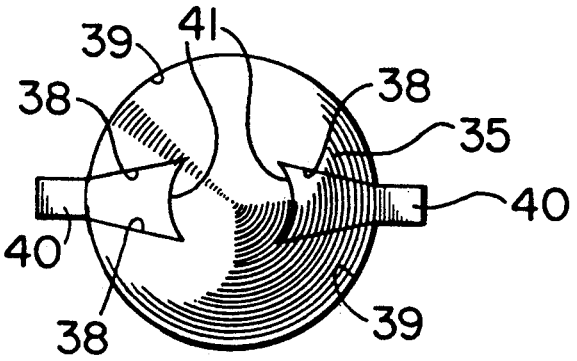
FIG. 3 is a bottom plan view of the dispenser compartment when loaded as shown in FIG. 2.
Figure 4:
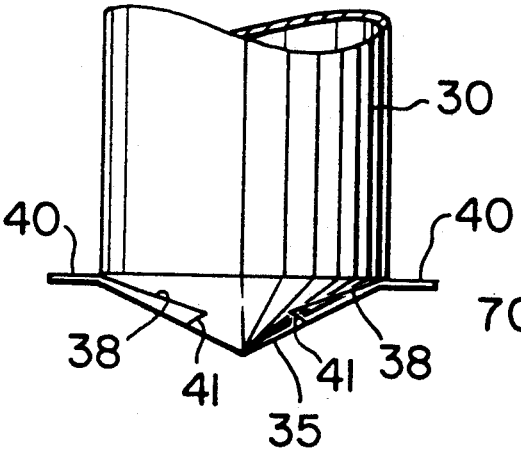
FIG. 4 is a side elevational view of the lower end of the dispenser compartment loaded as shown in FIG. 2.

As seen in FIGS. 3 and 4, the conical end 35 is provided with score line pairs 38 starting at the curved edge 39 and connecting to an associated one of a pair of diametrically opposed trigger tabs 40 and diverging to an associated arcuate central portion 41.

Figure 7:
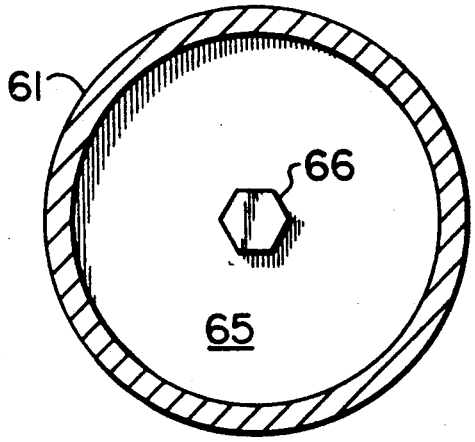
FIG. 7 is a transverse section along the line VII—VII of FIG. 6.
Figure 6:
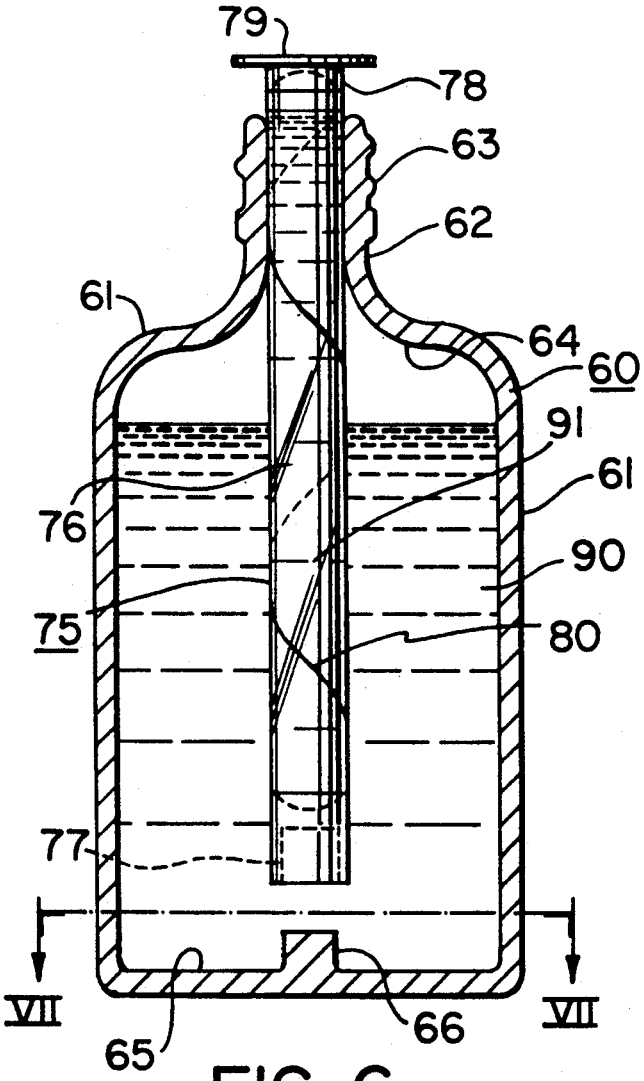
FIG. 6 is a central longitudinal section of another embodiment of the present invention with the dispenser compartment loaded and disposed within a container.
Figure 8:
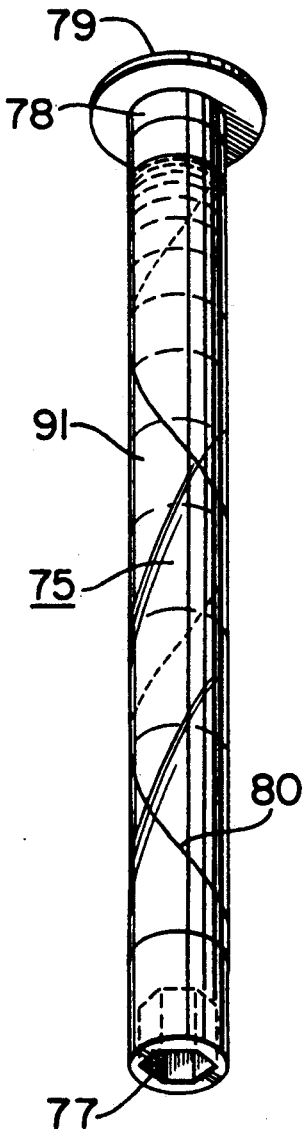
FIG. 8 is an isometric view of the sealed dispenser compartment of the embodiment of FIG. 6 which indicates how it can be unloaded.

(ii) Description of FIGS. 6–8

As seen in FIG. 6, the container 60 is a bottle 61 provided with a neck 62 having external screw threads 63, and a rounded shoulder 64 leading to the neck 62. The bottom 65 of the interior of the bottle 61 is fitted with an upstanding stub 66 of a predetermined geometrical shape, e.g. hexagonal.

The dispenser compartment 75 is a cylinder member 76 provided with a hollow lower end 77 of the same geometric shape as the upstanding stub 66 in the bottle 61, e.g. hexagonal. The upper end 78 of the cylindrical member 76 includes a cover flange 79 to be secured to a "twist-off" cap (not shown). The cylindrical member 76 is provided with helical score lines 80.

Figure 9:
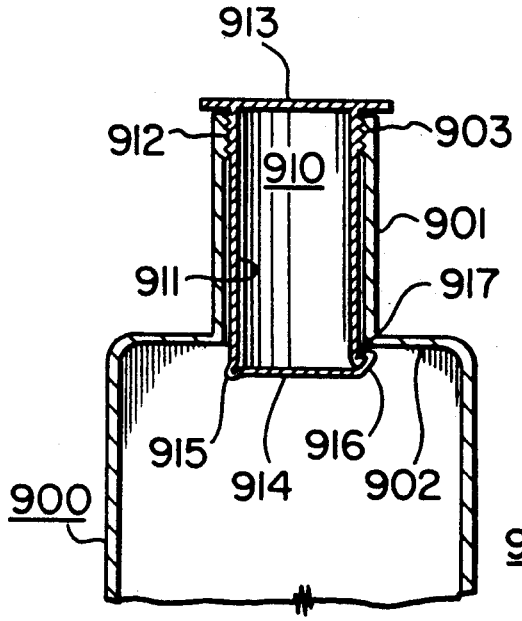
FIG. 9 is a central, longitudinal, sectional view of another embodiment of the present invention with the dispenser compartment loaded and disposed within the neck of a container.
Figure 10:
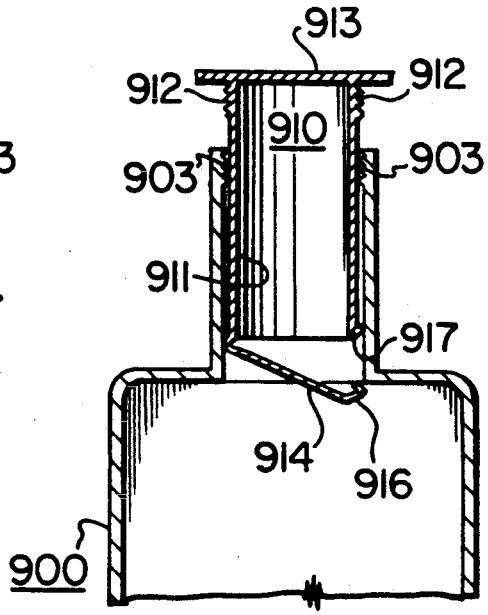
FIG. 10 is a central, longitudinal, sectional view of the embodiment of FIG. 9 with the dispenser compartment unloaded.
Figure 11:
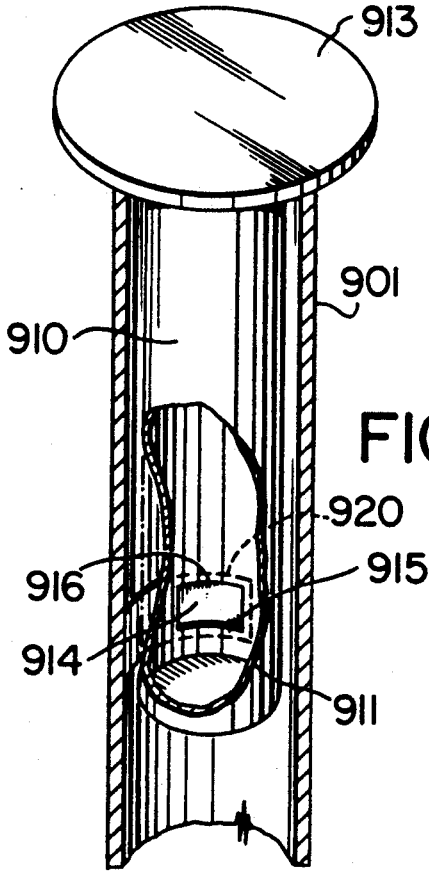
FIG. 11 is an isometric, partially, fragmentary view of a variation of the dispenser compartment of the embodiment of FIG. 9.

(iii) Description of Embodiment of FIG. 9, 10 and 11

As seen in FIGS. 9 and 10, container 900 is a bottle having a neck 901 provided with a square shoulder 902 and internal threads 903 The bottle is provided with one of the ingredients to be mixed, e.g. a liquid.

The dispenser compartment 910 includes a cylindrical wall 911 provided with external threads 912 and a top closure 913, which is closed after the dispenser compartment 910 is filled with a premeasurement amount of a second ingredient. The lower region of the dispenser compartment 910 is of generally rectangular cross-section and includes a rectangular bottom floor 914 held to one lower flat side wall 911 of the dispenser compartment 910 by "living hinge" 915, e.g. a weakened section. The bottom wall 914 includes a protrusion 916 which temporarily hooks onto a latch 917 on an opposed flat wall 911.

As shown in FIG. 11, the dispenser compartment 910 is also disposed vertically in the neck 901 of the bottle.

However, the dispenser compartment is provided with a door 914 in its wall. The door 914 includes an external protrusion 916, i.e. facing the interior wall of the neck 901, which wall is provided, at 920 with the latch 917. The door 914 is secured to the wall 911 by means of a "living hinge" 915 weakened section. The protrusion temporarily hooks onto the latch 917.

Figure 12:
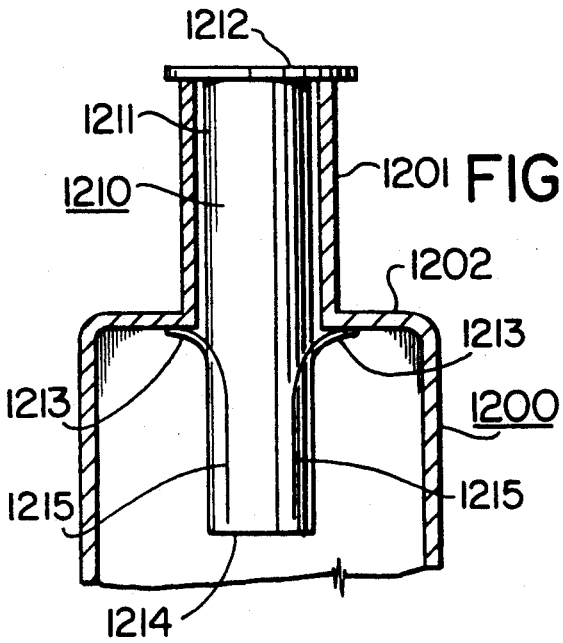
FIG. 12 is a central, longitudinal, sectional view of yet another embodiment of the present invention with the dispenser compartment loaded and disposed within the neck of the container.
Figure 13:
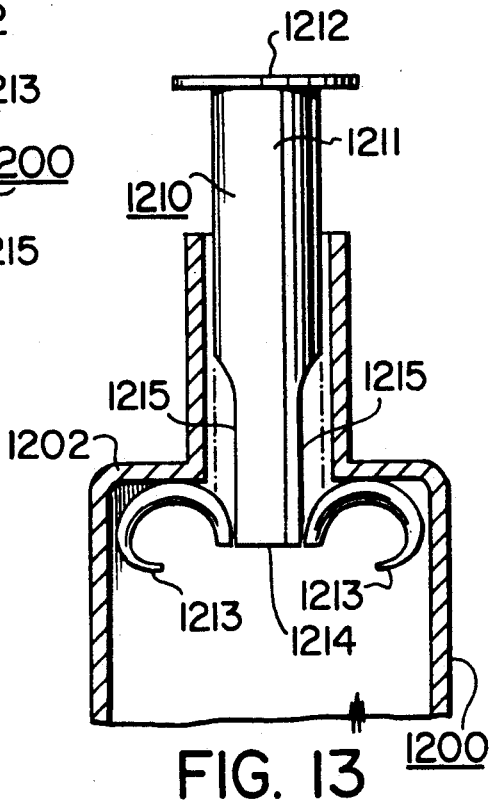
FIG. 13 is a central, longitudinal, sectional view of the embodiment of FIG. 12 with the dispenser compartment unloaded.

(iv) Description of Embodiment of FIGS. 12 and 13

As seen in FIGS. 12 and 13, the container is in the form of a bottle 1200 having a neck 1201 and a square shoulder 1202. The bottle is adapted to be filled with one of the ingredients to be mixed, e.g. a liquid.

The dispenser compartment 1210 includes cylindrical walls 1211 and a closure top 1212. The top is closed after a second ingredient is loaded into the dispenser compartment 1210. The area adjacent to the bottom 1214 of the dispenser compartment is provided with a plurality of vertically-extending, weakened portions 1215. The side walls 1211 of the dispenser compartment 1210 are provided with a flange-like protruding peripheral trigger 1213, adapted to engage the shoulder 1202.

Figure 14:
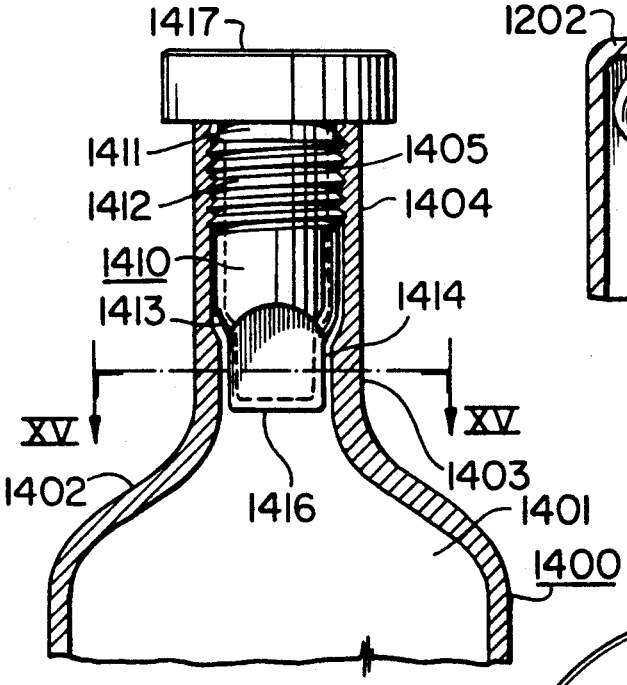
FIG. 14 is a central, longitudinal, sectional view of still another embodiment of the present invention with the dispenser compartment loaded and disposed within the neck of the container.
Figure 15:
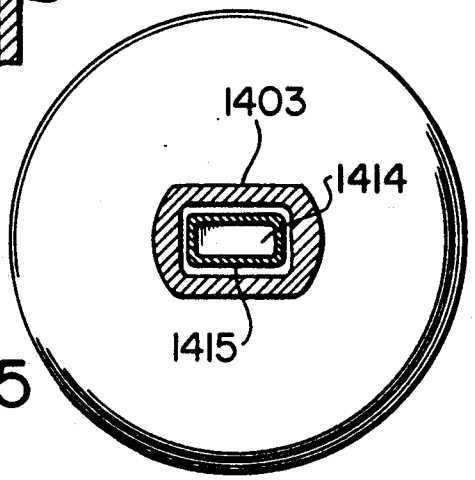
FIG. 15 is a cross-section along the line XV—XV of the embodiment of FIG. 14.

(v) Description of FIGS. 14 and 15

As seen in FIGS. 14 and 15, the container 1400 is in the form of a bottle 1401 having a rounded shoulder 1402, an oval constricted neck 1403 and a cylindrical head 1404, having internal threads 1405. Bottle 1401 is adapted to be filled with one of the ingredients to be mixed, e.g. a liquid.

The dispenser compartment 1410 includes a cylindrical head 1411 provided with external threads 1412, leading downwardly to a converging body 1413 and then to an oval neck 1414 having weakened or very thin and frangible thin walls 1415. A bottom 1416 is provided, along with a closure top 1417. Once the dispenser compartment 1410 is loaded with the second component, the closure top 1417 is put in place.

DESCRIPTION OF OPERATION OF PREFERRED EMBODIMENTS

Operation of the Embodiment of FIGS. 1-5

Figure 2:
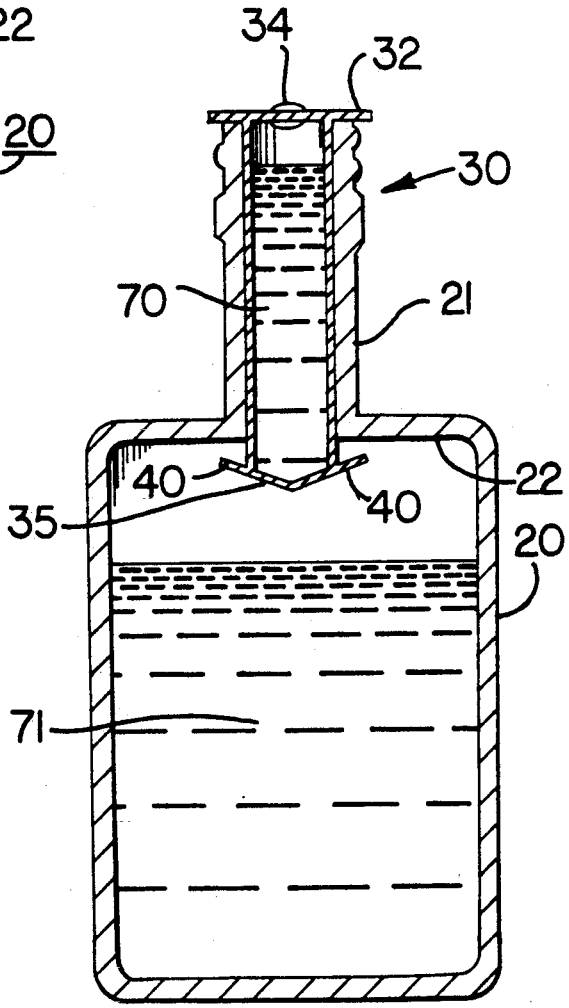
FIG. 2 is a central longitudinal section of the embodiment of FIG. 1 but with the dispenser compartment loaded.
Figure 5:
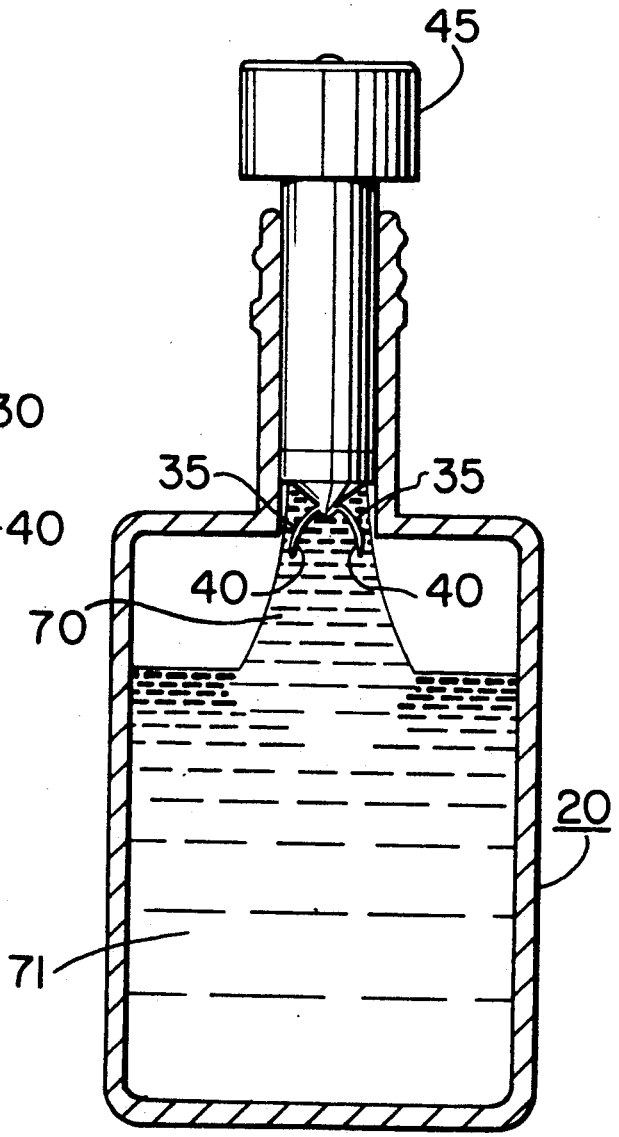
FIG. 5 is a central longitudinal section of the embodiment of FIG. 1 with the dispenser compartment just having been unloaded.
Figure 5A:
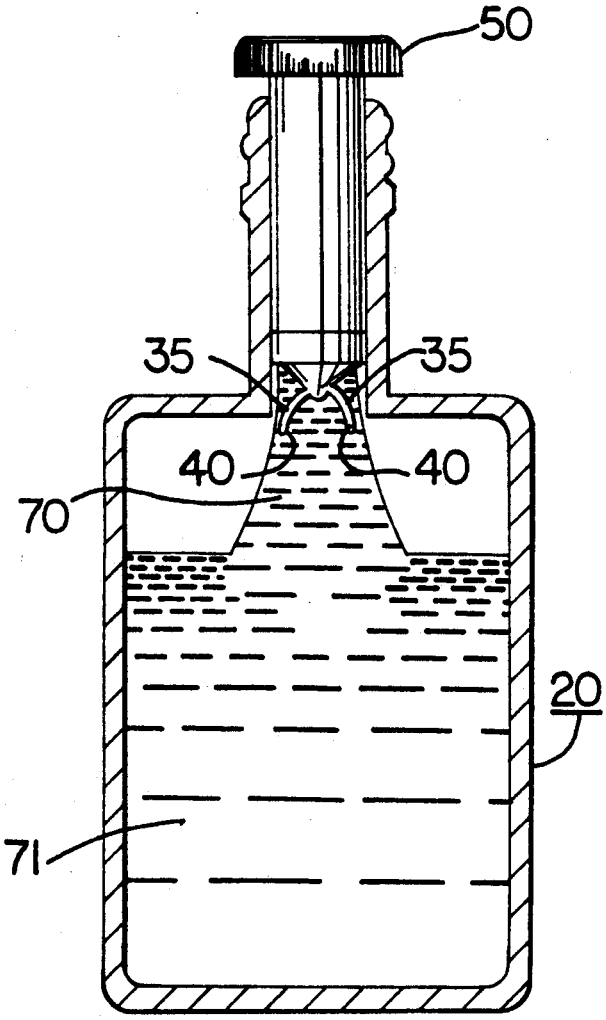
FIG. 5A is a central longitudinal section of the embodiment of FIG. 1 with the dispenser compartment just having been unloaded and wherein screw cap 45 has been replaced by twist-off bottle cap 50.

In use, the dispenser compartment 30, as seen in FIG. 1, is filled with a second ingredient 70 and the unit is "cocked" as seen in FIG. 2. When the dispensing container 30 is filled with a second ingredient 70 and is placed in the neck 21 of the bottle which is filled with a first ingredient 71, a cap 45 is secured to the cover flange 32. As seen in FIG. 5, when the cap 45 is unscrewed and the dispenser compartment/cap 45 unit is raised, the trigger tabs 40 abut the square shoulder 22 and rupture the dispenser compartment 30 along the score lines 38. As seen in FIG. 5, the contents 70 of the dispenser compartment 30 are released into the contents 71 of the bottle 20. As seen in FIG. 5A, a twist-off bottle cap 50 may be used in place of screw cap 45.

(ii) Operation of the Embodiment of FIGS. 6-8

In operation, the bottle 61 is filled with a first ingredient 90. The dispenser compartment 75 is filled with a second ingredient 91 and is inserted into the bottle 61 so that its bottom 77 mates with the stub 66 of the bottle. A screw cap (not shown) is secured to the flange 79 and is secured to the threads 63.

Upon unscrewing the screw cap, the dispenser container 75 tends to rotate but is prevented from doing so by the cooperation of 66/77. Thus, the rotation induced operates to unwind the dispenser container 75 along the spiral score line 80. This causes the second ingredient 91 in the dispenser compartment 76 to be released. Removal of the cap brings with it the dispenser compartment 75.

(iii) Operation of the Embodiments of FIGS. 9-11

If it is desired to dispose the contents of dispensing container 910 into the bottle 900 using the embodiment of FIGS. 9 and 10, the dispensing container 910 is rotated to cause it to be raised. This raising causes the protrusion 916 to abut the shoulder 902, causing the protrusion 916 to be freed from the latch 917. The weakened portion, i.e. the "living hinge" 915 thus allows the bottom 914 to drop, thereby unloading the dispensing container 910.

If the variant in FIG. 11 is used, the dispensing container 910 is unloaded by first rotating the dispensing container 910 and then by raising the dispensing container 910. The protrusion 916 is thus freed from the latch 917 allowing the door 914 to fall. Opening of the door 914 allows unloading of the dispensing container 910.

(iv) Operation of Embodiment of FIGS. 12 and 13

If it is desired to unload the dispensing container 1210, the closure of the dispensing container 1210 is pulled upwardly. This causes the trigger 1213 to abut the shoulder 1202 of the bottle 1200. Unlimited upward movement causes the peeling back of the weakened regions 1215, thereby unloading the dispensing container 1200 (as seen in FIG. 13).

(v) Operation of Embodiment of FIGS. 14 and 15

If it is desired to unload the dispensing container 1410, the dispensing container 1410 is rotated relative to the bottle 1400 to cause it to turn. This causes the oval neck 1413 of the dispensing container 1410 to be acted upon by the constricted oval neck 1403 of the bottle 1400. This causes the implosion of the weakened walls 1415 of the dispensing container 1410, thereby unloading the dispensing container 1410.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. The combination of:

(a) a container for containing a first ingredient, said container including an internal shoulder therein;

(b) a dispenser compartment for insertion into said container, for storing a second ingredient which is segregated from said first ingredient prior to use, said dispenser compartment having a preformed weakened region in a selected wall thereof;

(c) a removable closure for said container, said removable closure being connected to said dispensing compartment, said removable closure being adapted to close said container; and (d) means on said dispenser compartment for engaging said shoulder during removal of said closure;

whereby opening of said container by removal of said removable closure causes said means on said dispenser compartment to engage said shoulder in said container and to permit another portion of said dispenser compartment to be raised with respect to said container, thereby to rupture said weakened region of the selected wall of said dispenser compartment, and consequently to dispense said second ingredient into said first ingredient.

2. The combination of claim 1 wherein said weakened region comprises score lines and wherein opening of said container by removal of said removable closure causes a rupture of said dispenser compartment along said score lines of said selected wall.

3. The combination of claim 1 wherein said container comprises a bottle having a neck, and wherein said internal shoulder is disposed within said bottle below said neck.

4. The combination of claim 3 wherein said neck includes external threads thereon and wherein said removable closure is a screw cap.

5. The combination of claim 3 wherein: said weakened region comprises score lines, said dispenser compartment is a cylindrical body adapted to be concentrically disposed within said neck of said bottle; wherein said means on said compartment is adapted to engage said internal shoulder in said bottle below said neck, said dispenser compartment having a closed end provided with said score lines; and wherein removal of said removable closure causes vertically-upward movement of said dispenser compartment with respect to said neck of said bottle to effect rupturing along said score lies of said dispenser compartment.

6. The combination of claim 5 wherein: said closed end of said dispenser compartment being conically-shaped; and wherein said score lines are within said conically-shaped closed end.

7. The combination of claim 5 wherein said dispenser compartment includes a cover therefore, said cover being provided with a filler hole within which a plug is adapted to be placed to seal the compartment.

8. The combination of claim 7 wherein said cover includes a circular flange extending radially-outwardly therefrom.

9. The combination of claim 8 wherein said removable closure comprises a twist-off bottle cap which is provided with internal threads therein, said cap being secured to said circular flange.

10. The combination of claim 9 wherein rotation of said twist-off bottle cap causes vertically-upward movement of said dispenser compartment.

* * * * *

UNITED STATES PATENT AND TRADEMARK OFFICE

CERTIFICATE OF CORRECTION

PATENT NO. : 5,246,142

DATED : September 21, 1993

INVENTOR(S) : Elio DiPalma and Josephine DiPalma

It is certified that error appears in the above-identified patent and that said Letters Patent is hereby corrected as shown below:

Column 8, line 53, the following should be inserted:

--(ii) Statement of the Invention

Broadly speaking, the present invention provides an improvement in the combination of a container for containing a first ingredient, the container including an internal shoulder therein; (b) a dispenser compartment for insertion into the container, for storing a second ingredient which is segregated from the first ingredient prior to use, the dispenser compartment having a preformed weakened region in a selected wall thereof; (c) a removable closure for the container, the removable closure being connected to the dispensing compartment, the removable closure being adapted to close the container; and

UNITED STATES PATENT AND TRADEMARK OFFICE

CERTIFICATE OF CORRECTION

PATENT NO. : 5,246,142

DATED : September 21, 1993

INVENTOR(S) : Elio DiPalma and Josephine DiPalma

It is certified that error appears in the above-identified patent and that said Letters Patent is hereby corrected as shown below:

(d) means on the dispenser compartment for engaging the shoulder during removal of the closure, whereby opening of the container by removal of the removable closure causes the means on the dispenser compartment to engage the internal shoulders in the container and to permit another portion of the dispenser compartment to be raised with respect to the container, thereby to rupture the weakened region of the selected wall of the dispenser compartment, and consequently to dispense the second ingredient into the first ingredient.--

Column 15, line 9, replace "lies" with --lines--.

Signed and Sealed this

Twenty-ninth Day of March, 1994

Bruce Lehman

*Attest:*

BRUCE LEHMAN

*Attesting Officer*

*Commissioner of Patents and Trademarks*